US005249630A

United States Patent [19]

Meaders et al.

[11] Patent Number: 5,249,630

[45] Date of Patent: Oct. 5, 1993

[54] PERFORATING TYPE LOCKOUT TOOL

[75] Inventors: Michael W. Meaders, Lewisville; Rennie L. Dickson, Carrollton, both of Tex.

[73] Assignee: Otis Engineering Corporation, Dallas, Tex.

[21] Appl. No.: 823,283

[22] Filed: Jan. 21, 1992

[51] Int. Cl.[5] ..... E21B 34/06

[52] U.S. Cl. ..... 166/373; 166/55; 166/72; 166/323

[58] Field of Search ..... 166/55.3, 319, 323, 166/373, 374, 72, 322

[56] References Cited

U.S. PATENT DOCUMENTS

| | | | |
|---|---|---|---|
| 1,125,513 | 1/1915 | Graham | 166/55.3 |
| 3,111,989 | 11/1963 | Tamplen | 166/55.3 |
| 3,301,337 | 1/1967 | Vaughn et al. | 166/55.3 |
| 3,763,932 | 10/1973 | Dinning | 166/322 |
| 3,786,865 | 1/1974 | Tausch et al. | 166/224 S |
| 3,882,935 | 5/1975 | Calhoun | 166/224 A |
| 4,165,784 | 8/1979 | Gardner | 166/55.3 |
| 4,344,602 | 8/1982 | Arendt | 251/58 |
| 4,356,867 | 11/1982 | Carmody | 166/373 |
| 4,574,889 | 3/1986 | Pringle | 166/386 |
| 4,603,740 | 8/1986 | Edwards et al. | 166/323 |
| 4,603,742 | 8/1986 | Wong et al. | 166/373 |
| 4,723,606 | 2/1988 | Vinzant et al. | 166/319 |

*Primary Examiner*—Ramon Britts
*Assistant Examiner*—Frank S. Tsay
*Attorney, Agent, or Firm*—Jennifer R. Daunis; Monty L. Ross

[57] ABSTRACT

A tubing retrievable safety valve, lockout tool and method of use are disclosed that are adapted to lock the valve open permanently and provide access to control line pressure by perforating the piston in the valve. The lockout tool comprises a track mandrel having a ramp slidably disposed beneath a punch that is adapted to penetrate the piston wall of the valve at a point adjacent to the control fluid annulus, thereby creating a protrusion adapted to lock the valve open and establishing fluid communication between the control fluid annulus and the valve bore.

20 Claims, 10 Drawing Sheets

PERFORATING TYPE LOCKOUT TOOL

BACKGROUND OF THE INVENTION

1. Field of the Invention

This invention relates to surface controlled subsurface safety valves used in the oil and gas industry, and more particularly, to an improved tubing retrievable subsurface safety valve ("TRSV") and a perforating type lockout tool.

2. Description of Related Art

It is common practice to complete oil and gas producing wells with systems including a subsurface safety valve controlled from the well surface to shut off fluid flow through a well tubing string. Frequently it is also necessary to conduct well servicing operations through a subsurface safety valve. In some instances, the safety valve can be locked open temporarily, either by using control fluid pressure or by running a shifting tool into the tubing by wireline. In other instances, such as when a safety valve malfunctions and another valve is inserted, or when a second safety valve is to be installed at a different location in the well, it may be desirable to use a shifting tool to permanently lock a subsurface safety valve in its open position.

Tubing retrievable, flapper type safety valves have previously been disclosed, for example, in U.S. Pat. No. 4,723,606. Such valves typically comprise a housing connectable with a well tubing string, a bore for communicating well fluid flow, a flapper valve mounted inside the housing for movement between open and closed positions, and an operator tube in the housing to shift the flapper valve selectively between the two positions. The operator tube normally moves in response to a control signal from the well surface, but a shifting tool can releasably engage the operator tube for movement independently of the control signal. A lockout sleeve may be mounted in the housing in tandem with the operator tube for movement between a first position engaging and holding the flapper valve open and a second position of disengagement from the flapper valve.

Subsurface safety valves including both a permanent and a temporary lock open mechanism are also disclosed, for example, in U.S. Pat. Nos. 3,786,865; 3,882,935; 4,344,602; and 4,356,867. However, the design features that enable these conventional safety valves to be locked open either temporarily or permanently in the absence of control line pressure have made the valves more complicated and expensive than is needed or desirable for all markets and applications.

The use of a punch as a perforator for well flow conductors is disclosed in U.S. Pat. No. 3,111,989. The use of a punch to create outwardly extending indentations in a flow tube for locking out a well safety valve is disclosed in U.S. Pat. No. 4,574,889. The apparatus disclosed in U.S. Pat. No. 4,574,889 does not, however, provide a path for control fluid communication with the valve bore. Nor does the apparatus disclosed in U.S. Pat. No. 4,574,889 use an outwardly extending lip created by perforation to lock the valve open.

SUMMARY OF THE INVENTION

According to the present invention, a TRSV and lockout tool are provided that cooperate to lock the valve open permanently and provide access to control line pressure by perforating the piston in the valve. The invention disclosed herein provides an economical and reliable locking mechanism with fewer leak paths than conventional tubing retrievable safety valves.

According to one embodiment of the invention, a subsurface safety valve is provided that is adapted to be locked permanently open in such manner that control fluid communication is also established between a surface controller and the valve bore.

According to another embodiment of the invention, a lockout tool is provided that comprises a track mandrel having a ramp slidably disposed beneath a punch adapted to penetrate the piston wall of the valve at a point adjacent to the control fluid annulus, thereby creating a tab for locking the valve open and simultaneously establishing fluid communication between the control fluid annulus and the valve bore. Alternatively, the punch can be adapted to perforate the piston and form an outwardly extending lip adapted to lock the valve open, or to perforate the piston and wedge an insert into the perforation that will lock the valve open. With either alternative, fluid communication is likewise established between a surface controller and the valve bore.

According to another embodiment of the invention, a lockout tool for a TRSV is provided that comprises means for permanently locking the TRSV open in combination with perforation means adapted to establish control line communication with the interior of the open valve.

According to another embodiment of the invention, a TRSV and lockout tool are provided that can be operated to permanently lock a subsurface safety valve such as, for example, a poppet, flapper or ball valve open by shifting an operating sleeve to a position where it holds the valve open and thereafter perforating a piston in the valve to create a tab capable of preventing the operating sleeve from shifting back to an unlocked position.

According to another embodiment of the invention, a flow control system for an oil or gas well is provided that comprises a tubing supported subsurface safety valve and a lockout tool adapted to lock the safety valve open. The subsurface safety valve preferably comprises a housing with a longitudinal bore, a valve closure member adapted to be moved from a first position blocking fluid flow through the tubing to a second position permitting fluid flow through the tubing, an operating sleeve adapted to slide downwardly within the longitudinal bore to maintain the valve closure member in the second position, and a spring-biased piston member adapted to slide in unison with the operating sleeve. The lockout tool of the invention is adapted for insertion into the longitudinal bore of the safety valve, and preferably comprises a housing with a longitudinal bore, means disposed in the housing for releasably engaging the operating sleeve of the safety valve, and mandrel means slidably disposed in the longitudinal bore of the lockout tool. The mandrel means of the lockout tool preferably further comprises a punch member and means for forcing the punch member radially outward to penetrate the piston member when (1) the lockout tool housing and the operating sleeve are engaged, (2) the operating sleeve is maintaining the valve closure member in the second position, and (3) the mandrel means is forced downward in relation to the lockout tool housing and the safety valve. The punch member of the invention is preferably adapted to form an outwardly extending tab on the piston member that will engage an annulus in the housing of the safety valve and limit subsequent upward movement of the piston member and operating sleeve relative to the safety valve housing, thereby permanently locking the safety valve in the open position. Alternatively, the punch member is adapted to perforate the piston so as to form an outwardly extending lip, or to wedge an insert into the perforation. Each means of perforating the piston simultaneously establishes a path for fluid communication between a surface controller and the valve bore.

According to another embodiment of the invention, a method is provided for permanently locking open a TRSV and simultaneously establishing fluid communication between the valve bore and a surface controller, comprising the steps of introducing a tubing string including a TRSV into a well bore; introducing a lockout tool through the tubing string into the TRSV; releasing a first retaining means within the lockout tool, thereby causing locator keys in the lockout tool to engage a profile in the TRSV; increasing pressure in the tubing string above the TRSV and lockout tool, thereby shifting an operating sleeve in the TRSV to a position where it prevents closure of a valve closure means within the TRSV; releasing a second retaining means within the lockout tool, thereby causing means within the lockout tool to perforate a piston in the TRSV at a point adjacent an annulus in the TRSV that is in fluid communication with a surface controller, locking the operating sleeve and valve closure member in the open position and establishing fluid communication between the surface controller and the well bore; and thereafter causing the locator keys of the lockout tool to disengage from the profile in the TRSV, permitting withdrawal of the lockout tool from the tubing string.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
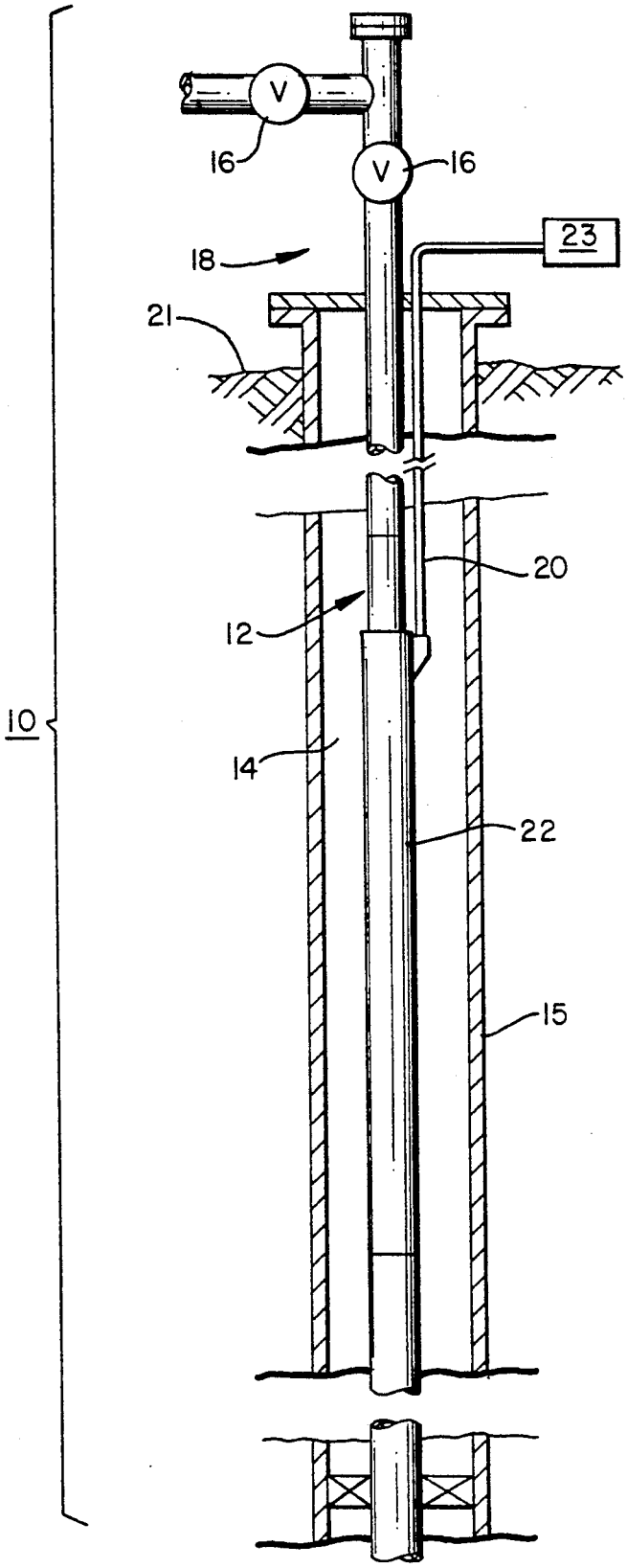
FIG. 1 is a schematic view in section and elevation of a typical well completion including a tubing retrievable subsurface safety valve with a flapper type valve closure means.

FIG. 1 is a schematic representation of a TRSV installation 10 wherein tubing string 12 is deployed in bore 14 of casing 15. Valves 16 at wellhead 18 control the flow of fluids through tubing string 12 at surface 21, and TRSV 22 controls the flow of fluids through tubing string 12 below surface 21. TRSV 22 can be operated from the surface by controller 23, which is in fluid communication with TRSV 22 through control line 20.

The construction and operation of TRSV 22 and lockout tool 24, which is used to permanently lock TRSV 22 open, are further described and explained in relation to FIGS. 2, 3, 4 and 5. Referring to FIGS. 2A and 2B, TRSV 22 preferably comprises top sub 30 and housing subassemblies 32, 34, 36 and 38. The upper end of top sub 30 is threaded onto the bottom of tubing section 26. Threaded connection 40 is provided near the top of housing subassembly 32 for connection of control line 20 as shown in FIG. 1. Flow channel 41 provides fluid communication through housing subassembly 32 between threaded connection 40 and annulus 44.

Figure 2A:
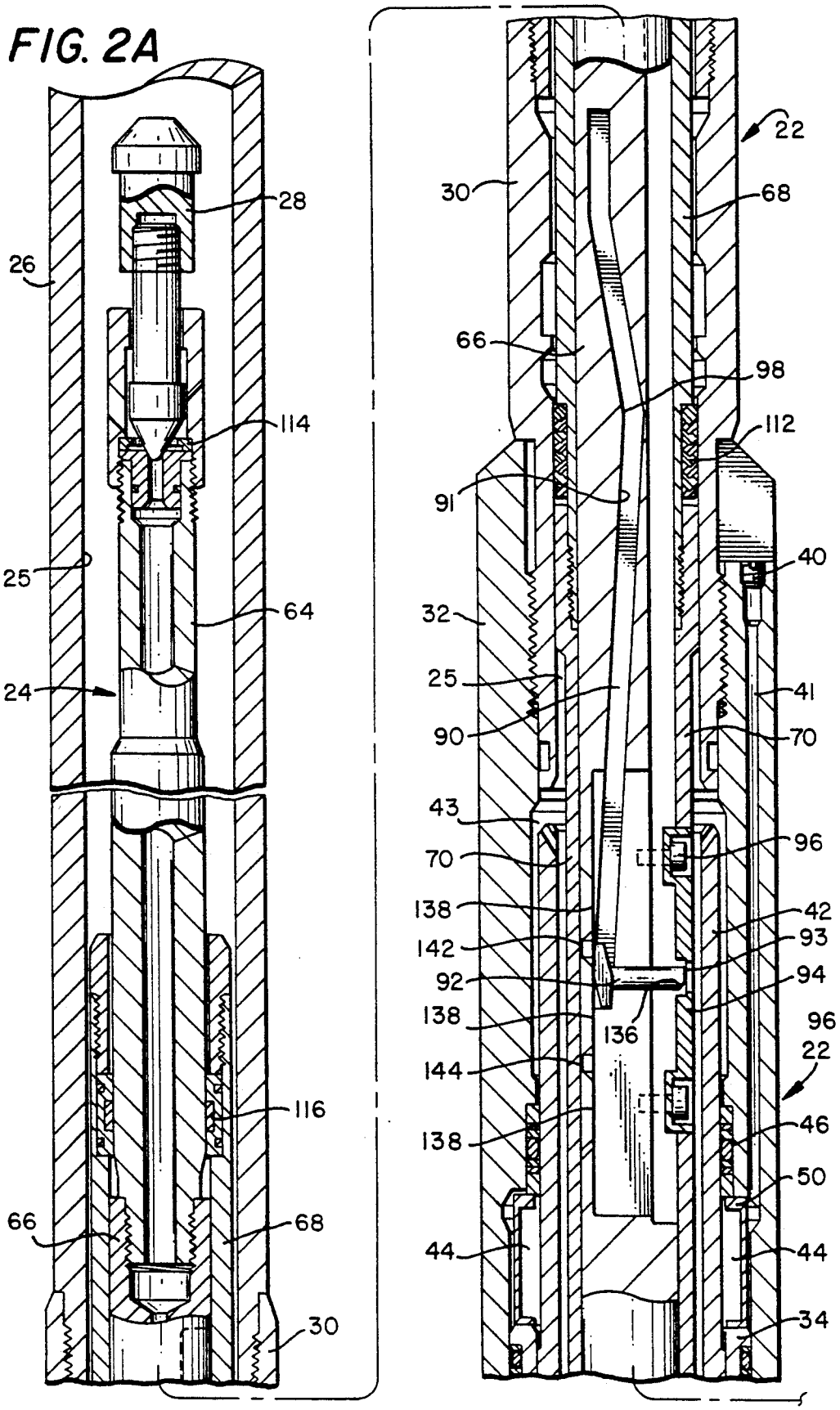
FIGS 2A and 2B, taken together, form a longitudinal view in section and elevation with portions broken away of the TRSV and lockout tool as the lockout tool is being run into the valve.
Figure 2B:
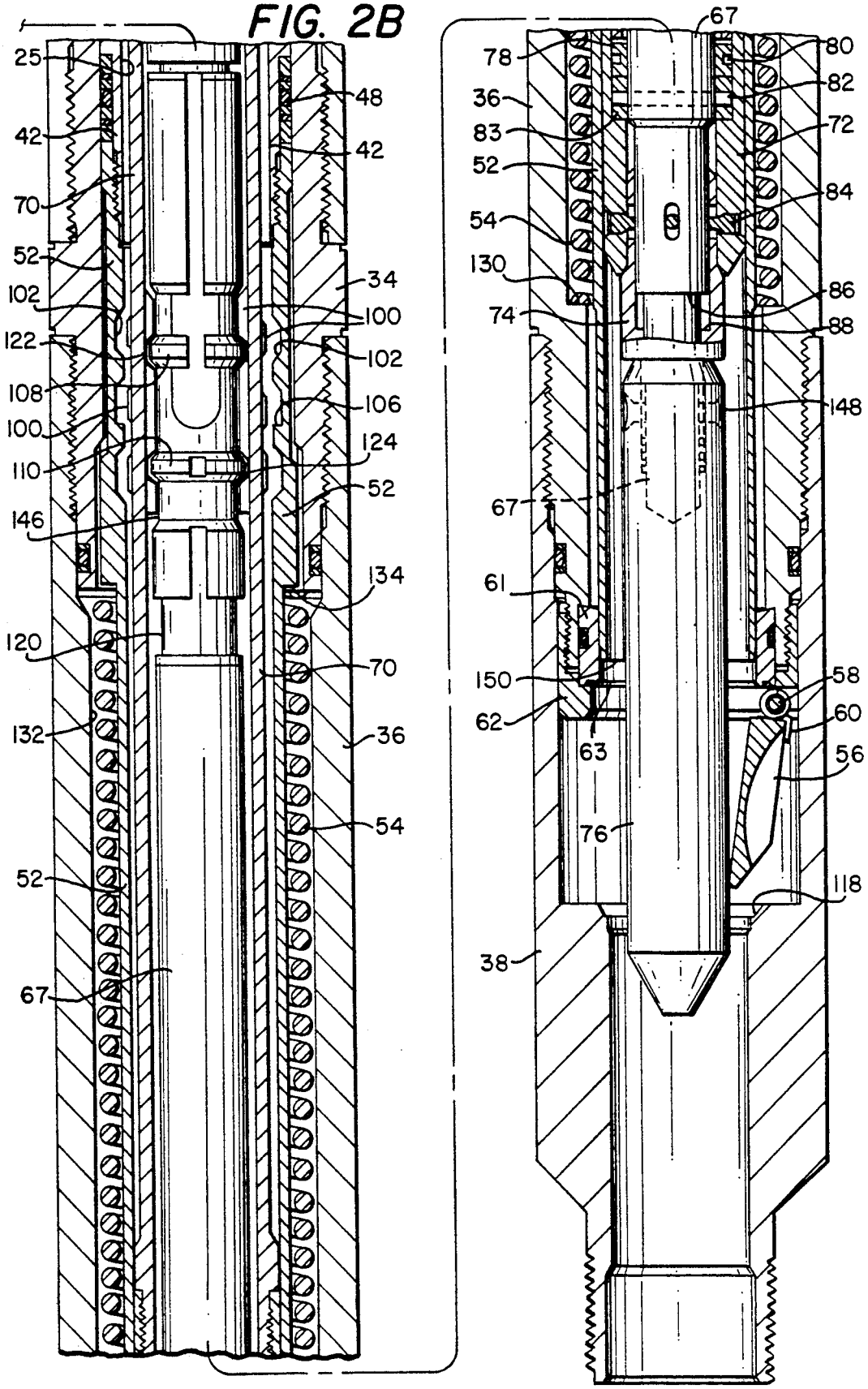

Piston 42 is slidably disposed inside bore 43 of housing subassemblies 32, 34, and is threaded into the upwardly extending end of operating sleeve 52 as shown in FIG. 2A and 2B. Sealing stack 46, held in place by packing retainer 50 as shown in FIG. 2A, is provided to restrict leakage of control fluid out of annulus 44 between piston 42 and the inwardly facing wall of housing subassembly 32. Sealing stack 48 is likewise provided between piston 42 and housing subassembly 34 as shown in FIG. 2B to restrict fluid leakage downwardly from annulus 44. Coil spring 54 is disposed in the cylindrical space between the outwardly facing surface of operating sleeve 52 and inside wall 132 of housing subassembly 36. The bottom of coil spring 54 is supported by upwardly facing annular shoulder 130 of housing subassembly 36, and the top of coil spring 54 engages downwardly facing annular shoulder 134 of operating sleeve 52. Valve housing 62, threaded onto the bottom of housing subassembly 36 inside housing subassembly 38, retains a seat insert 61 which provides a seating surface 63 for flapper 56. Flapper 56 is pivotally connected by hinge 58, and is biased toward its closed position against valve seat 62 by torsion spring 60. (Although TRSV 22 is described herein as having a flapper valve closure means, it will be understood that the method and apparatus of the invention are likewise applicable to safety valves having poppet, ball or other similarly effective closure means.)

Lockout tool 24 is preferably run into tubing string 12 by wireline or reeled tubing (not shown) to a position inside tubing 26 and TRSV 22 as shown in FIGS. 2, 3, 4 and 5. Fishing neck 28 or other similarly effective means is preferably provided for attaching lockout tool 24 to a wireline tool string. Lockout tool 24 of the invention preferably comprises seal mandrel 64, track mandrel 66, lower mandrel 67, upper housing 68, locator housing 70, lower housing 72, shear sub 74 and nose 76.

Referring to FIGS. 2A and 2B, seal mandrel 64 and track mandrel 66 are threadedly engaged and are slidably disposed inside the cylindrical bores of upper housing 68 and locator housing 70. Track mandrel 66 further comprises internal track 90 having a ramp 91 that slidably engages the bottom surface of punch 92. Punch 92 is preferably aligned with aperture 93 through cover plate 94, which is disposed in a window of locator housing 70. For reasons discussed in greater detail below in relation to FIGS. 5A and 5B, the outside diameter of track mandrel 66 preferably has a recessed area 138 comprising upsets 142, 144 that define a profile adapted to conform to the inwardly facing surface of locator keys 100 disposed in locator housing 70.

Locator housing 70 preferably comprises a plurality of circumferentially spaced, radially expandable locator keys 100 that are biased outwardly by springs (not shown) to encourage them to engage profile 102 in operating sleeve 52 for properly positioning lockout tool 24 inside TRSV 22. As shown in FIG. 2B, lower mandrel 67 is oriented in relation to locator keys 100 so as to allow them to retract into recesses on lower mandrel 67 as lockout tool 24 passes through restrictions in bore 25. Recesses 146 and upsets 108, 110 on the outside diameter of lower mandrel 67 are adapted to conform to the inwardly facing surface of locator keys 100 so that as locator keys 100 are retracted within locator housing 70, upsets 108, 110 on lower mandrel 67 nest inside recesses 122, 124, respectively, of locator keys 100.

Well fluids present in tubing string 12 during running can bypass lockout tool 24 through conventional internal communication porting (not shown), after which the fluids pass out the top of lockout tool 24 through a poppet type valve.

In the running configuration, as shown in FIGS. 2A and 2B, lockout tool 24 is "pinned" with a single primary shear pin 82 and a single or plurality of secondary shear screws 84. Alternatively, it will be appreciated other similarly effective releasable retaining means can likewise be used in place of shear pin 82 and secondary shear screws 84. Shear ring 83, which contains primary shear pin 82, is pulled down against the internal shoulder of lower housing 72 by tightening nose 76 against shear sub 74. Nose 76 is locked in place by set screws 148 which pass through nose 76 and engage lower mandrel 67.

As lockout tool 24 is run downhole into TRSV 22, nose 76 preferably has sufficient length to push the closed flapper 92 of the TRSV 22 off valve seat 62 before locator keys 100 land in internal profile 102. This insures that pressure across the TRSV 22 is equalized prior to lockout tool 24 locating in position. When locator keys 100 engage profile 102, the downward movement of lockout tool 24 is stopped. With locator keys 100 in profile 102, packing stack 112 of lockout tool 24 engages honed bore 25 of top sub 30 of TRSV 22.

Figure 3A:
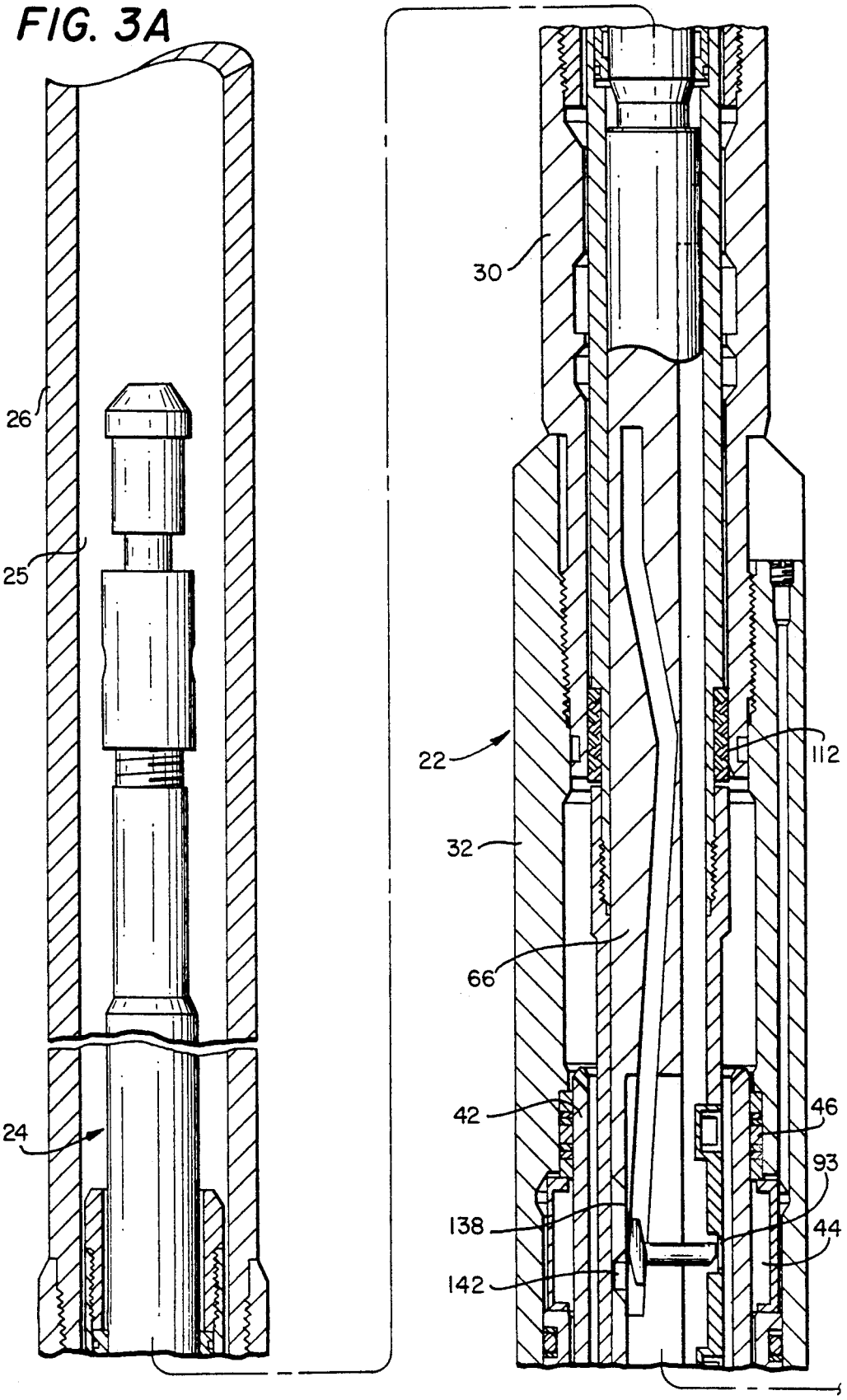
FIGS. 3A and 3B, taken together, depict the apparatus of FIGS. 2A and 2B during actuation of the TRSV.
Figure 3B:
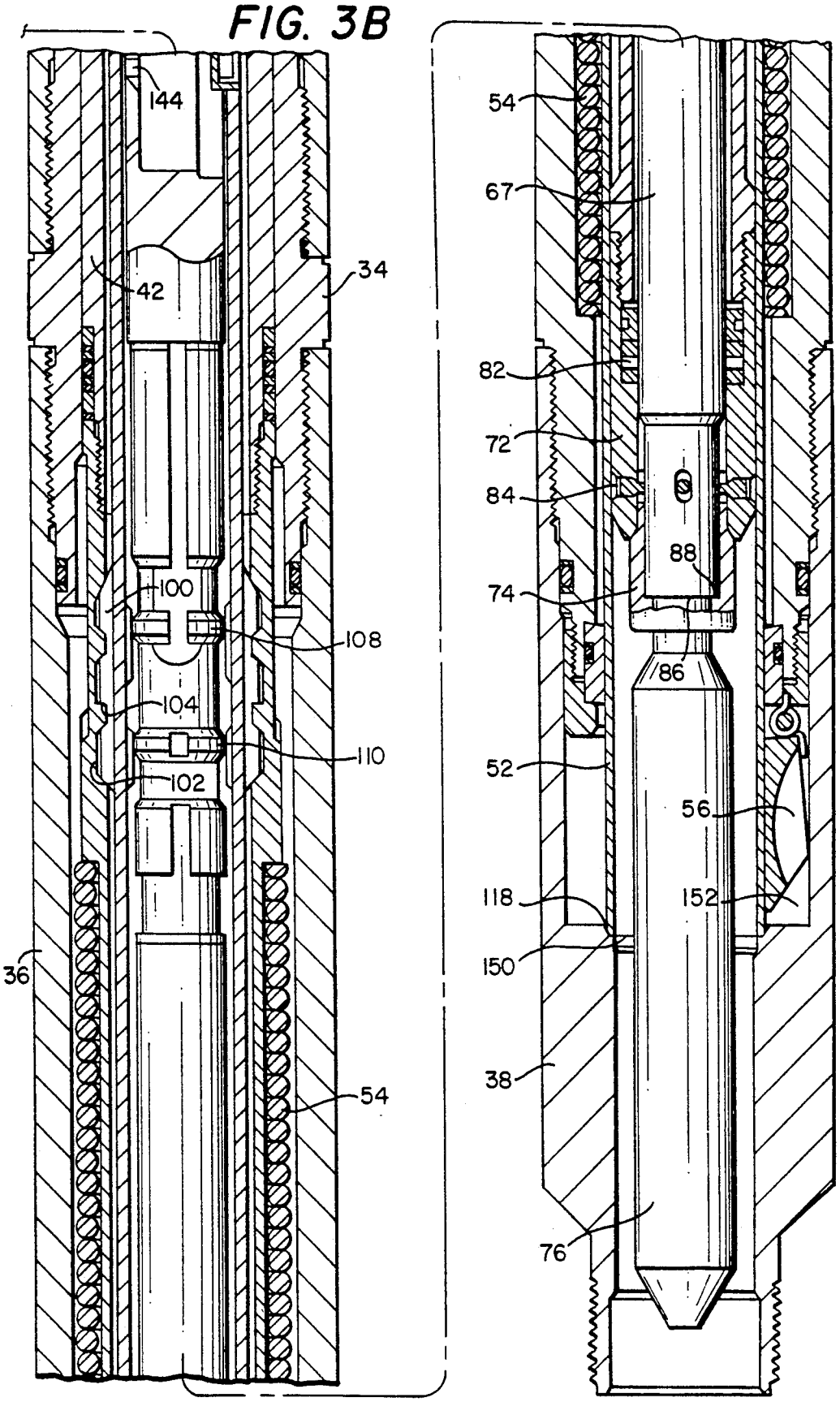

Referring to FIGS. 3A and 3B, light downward jarring is then used to shear primary shear pin 82. When primary shear pin 82 shears, lower mandrel 67 slides downward relative to lower housing 72 until lower edge 86 abuts against annular shoulder 88 of shear sub 74, thereby loading secondary shear screws 84. This downward movement causes upsets 108, 110 on lower mandrel 67 to back up locator keys 100, forcing them to remain engaged in profile 102 of TRSV 22.

At this point, the pressure in tubing 26 above TRSV 22 and lockout tool 24 can be increased by pumping fluid downward from the surface because seal members 112, 114 (FIG. 2A) and 116 cooperate to seal off the cross-sectional area within the tubing. When the tubing pressure above TRSV 22 and lockout tool 24 exceeds the combined tubing pressure below TRSV 22 and the spring force of spring 54, lockout tool 24 slides downwardly through bore 25. Locator keys 100, which are maintained in profile 102 of operating sleeve 52 by upsets 108, 110, simultaneously cause piston 42 and operating sleeve 52 to slide downwardly through housing subassemblies 36, 38 until bottom edge 150 abuts against annular stop 118 as shown in FIG. 3B. When operating sleeve 52 reaches the position shown in FIG. 3B, flapper 56 of TRSV 22 is held open and confined within annular space 152 in housing subassembly 38. (While increased tubing pressure is described herein as a preferred means for shifting operating sleeve 52 downwardly through TRSV 22, it will be understood by those of ordinary skill in the art that other similarly satisfactory means such as increased control line pressure, jarring or stem weight can likewise be used to open TRSV 22 under appropriate circumstances within the scope of the present invention.)

Figure 4A:
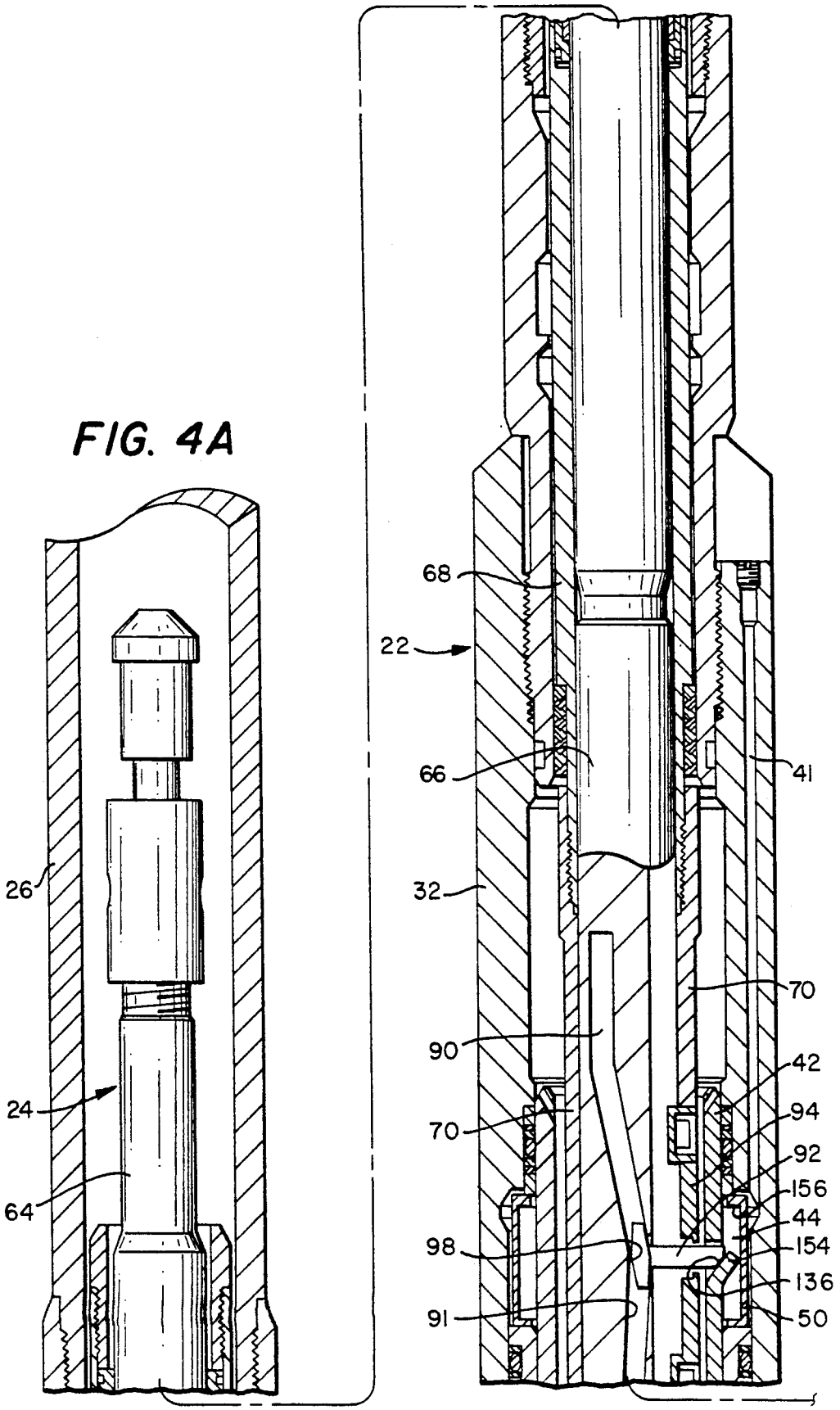
FIGS. 4A and 4B, taken together, depict the apparatus of FIGS. 3A and 3B during perforation of the piston and lockout of the TRSV.
Figure 4B:
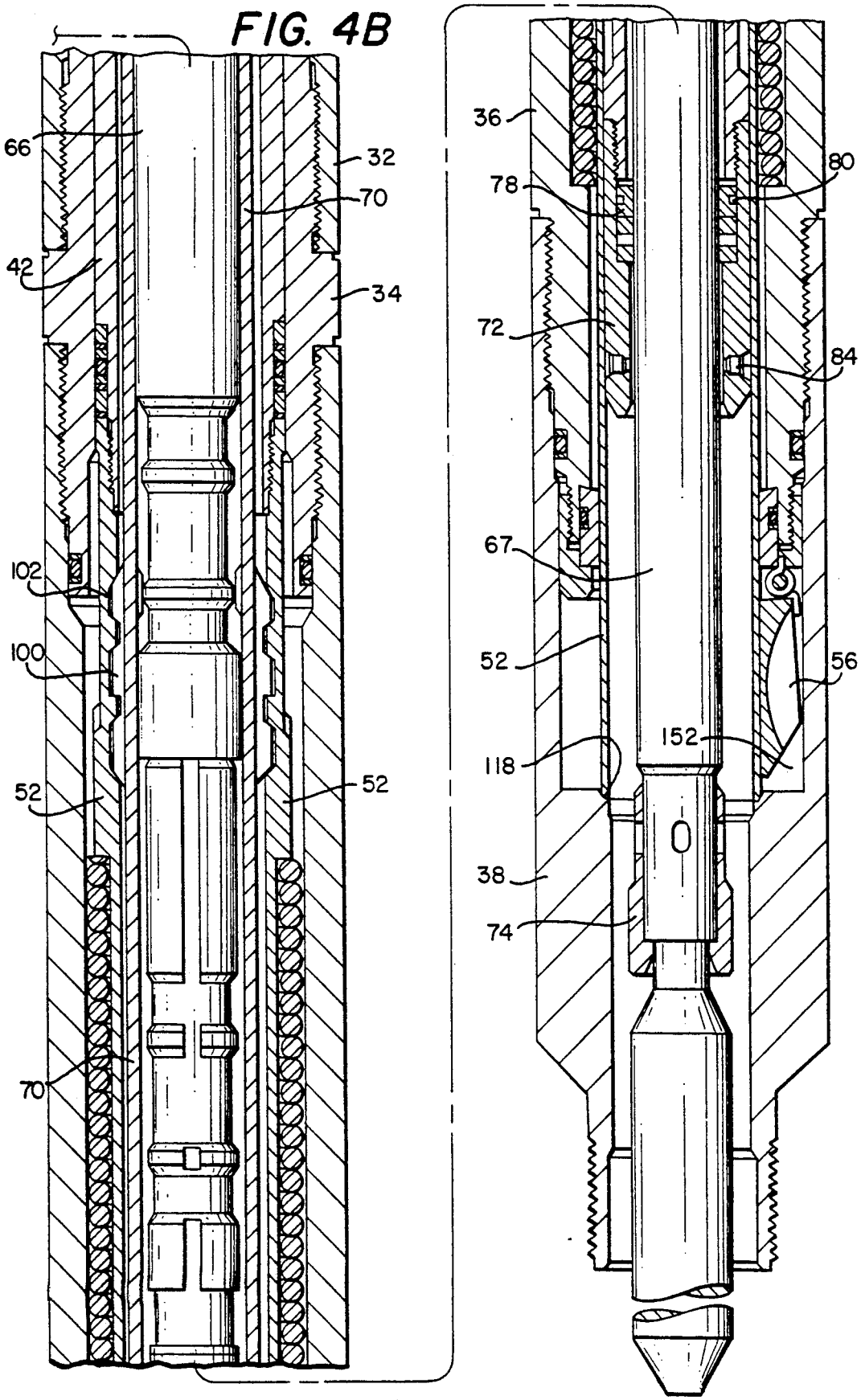

The perforation of piston 42 and permanent lockout of flapper 56 of TRSV 22 are further described and explained in relation to FIGS. 4A and 4B. While maintaining the tubing pressure used to move TRSV 22 to the open position, further downward jarring is used to shear secondary shear screws 84. This disengages shear sub 74 from lower housing 72 of lockout tool 24, permitting seal mandrel, track mandrel 66 and lower mandrel 67 to slide downward relative to upper housing 68, locator housing 70 and lower housing 72. As track mandrel 66 slides downward through locator housing 70, punch 92 slides up ramp 91 of track 90 to apex 98 of ramp 91 as shown in FIG. 3A. As punch 92 slides up ramp 91, it is forced radially outward, protruding through aperture 93 in cover plate 94, then engaging and penetrating through piston 42 at a point adjacent to annulus 44. Because of beveled edge 136 on the outwardly extending end of punch 92, outwardly extending tab 154 is preferably formed on piston 42. Tab 154 thereafter prevents piston tube 42 and operating sleeve 52 from sliding upward relative to housing subassemblies 32, 34, 36 and 38 a sufficient distance for flapper 56 to close, permanently locking TRSV 22 open. (Although the apparatus as shown in FIGS. 1 through 5 is not drawn to scale to facilitate illustration, it should be understood that the range of travel permitted before the upwardly extending end of tab 154 abuts shoulder 156 of packing retainer 50 is not sufficient to permit any appreciable closure of flapper 56.) The opening created by punch 92 in piston 42 also establishes control line communication with the bore of TRSV 22, which may be desirable for subsequent operations such as the control of an insert valve.

Figure 5A:
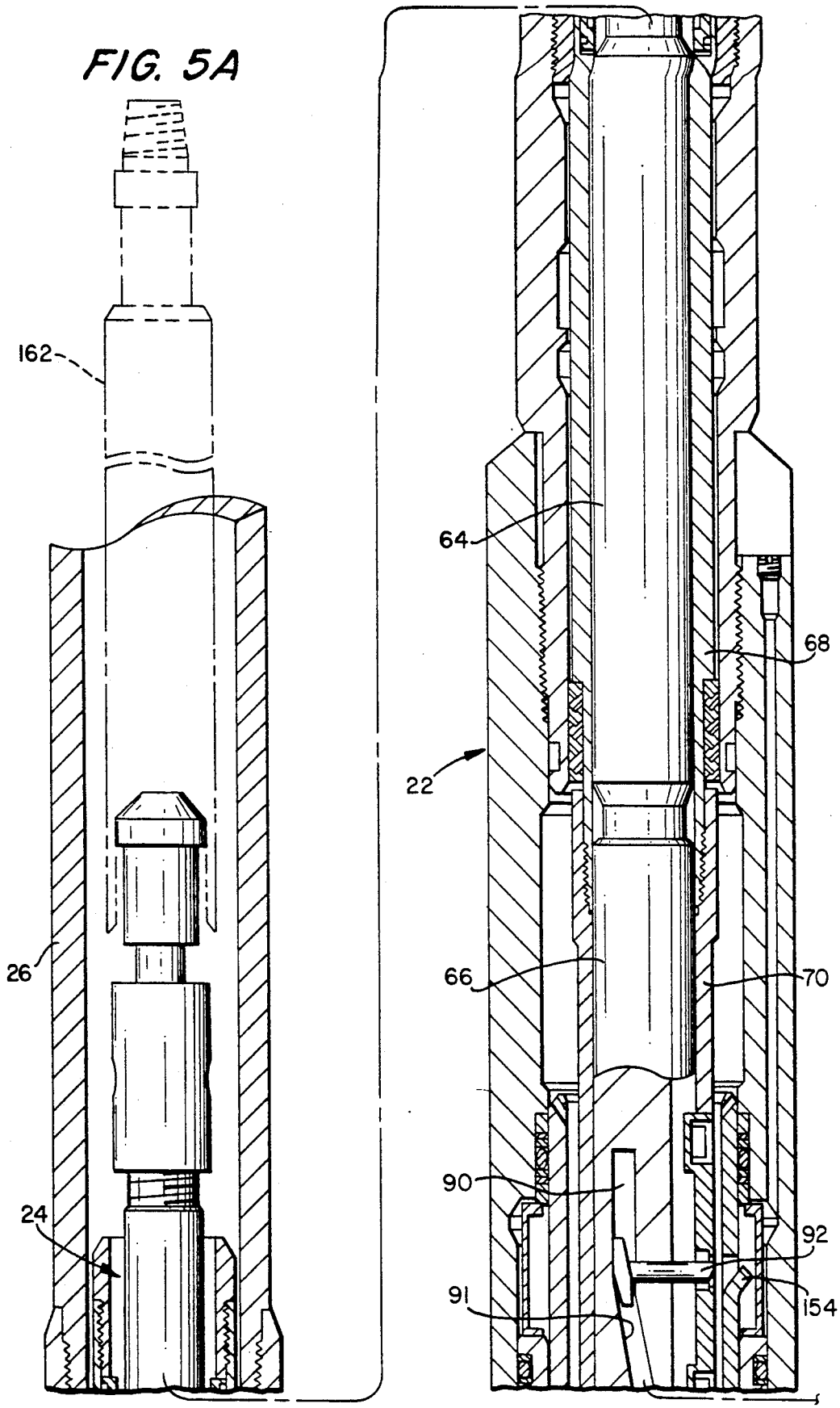
FIGS. 5A and 5B, taken together, depict the apparatus of FIGS. 4A and 4B during release and retrieval of the lockout tool of the invention.
Figure 5B:
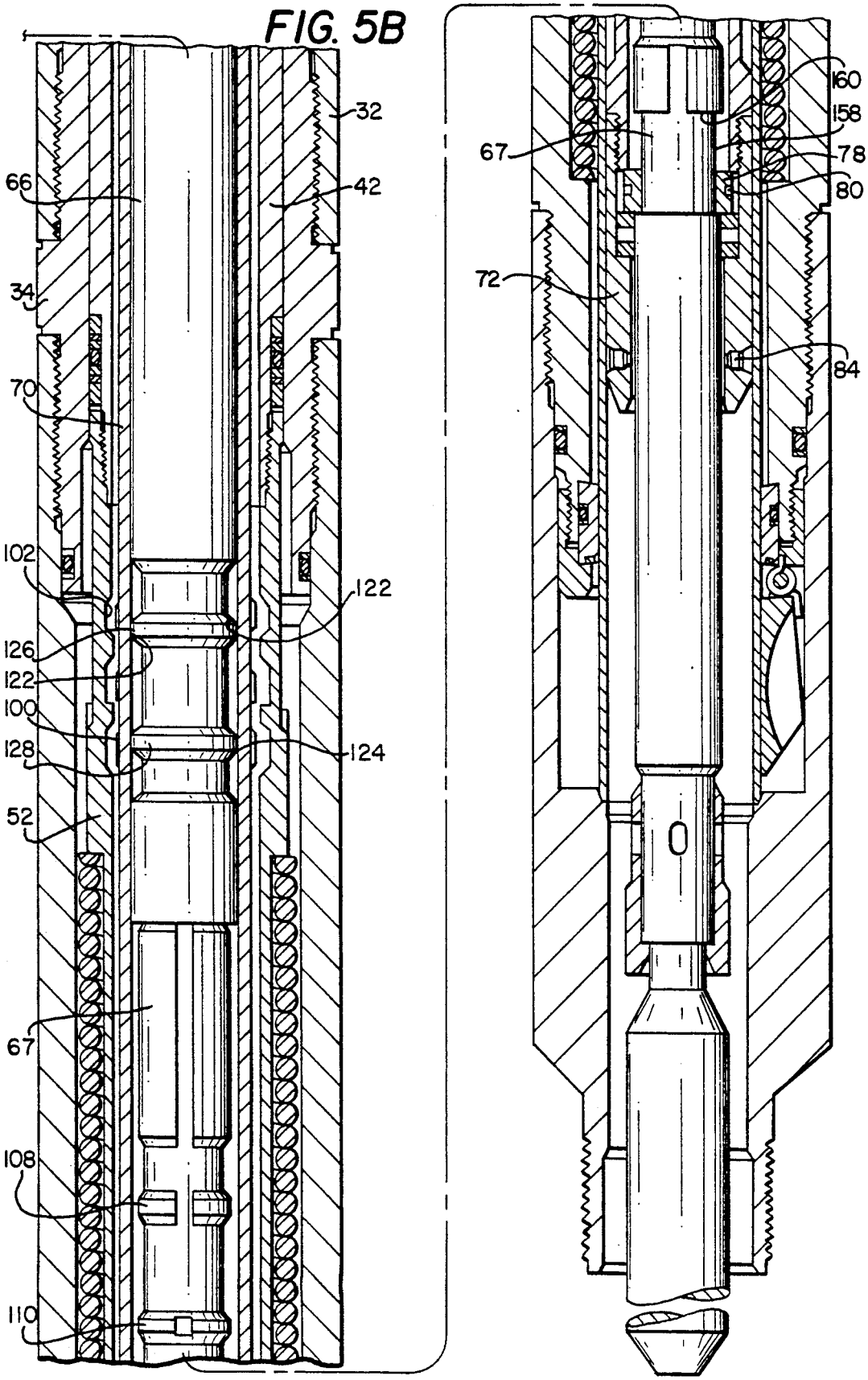

The release and retrieval of lockout tool 24 from TRSV 22 is described and explained in relation to FIGS. 5A and 5B. After punch 92 perforates the wall of piston 42, forming tab 154, continued downward movement of seal mandrel 64, track mandrel 66 and lower mandrel 68 due to the jarring and hydraulic forces causes punch 92 to be retracted by track 90 back into locator housing 70. As punch 92 is retracted inside locator housing 70, lower mandrel 67 travels downward relative to lower housing 72 to a point where lock ring segments 78 drop into recess 158 and are maintained there by garter spring 80. Further downward movement of seal mandrel 64, track mandrel 66 and lower mandrel 67 relative to upper housing 68, locator housing 70 and lower housing 72 of lockout tool 24 past that point is limited because collar 160 will engage collapsed lock ring segments 78. After punch 92 is retracted, the sealing diameter of seal mandrel 64 loses contact with seal assembly 116, thereby venting the pressure being applied above lockout tool 24 and giving a positive indication at the surface that lockout tool 24 has completed its cycle.

As track mandrel 66 and lower mandrel 67 move downward to the position shown in FIGS. 5A and 5B, upsets 126, 128 in track mandrel 66 are moved to a position adjacent recesses 122, 124 in the underside of locator keys 100. This alignment permits locator keys 100 to retract out of profile 102 and into locator housing 70, releasing lockout tool 24 from TRSV 22. Lockout tool 24 can then be retrieved to the surface by a conventional Type "RB" pulling tool 162 as manufactured by Otis Engineering Corporation.

Figure 6:
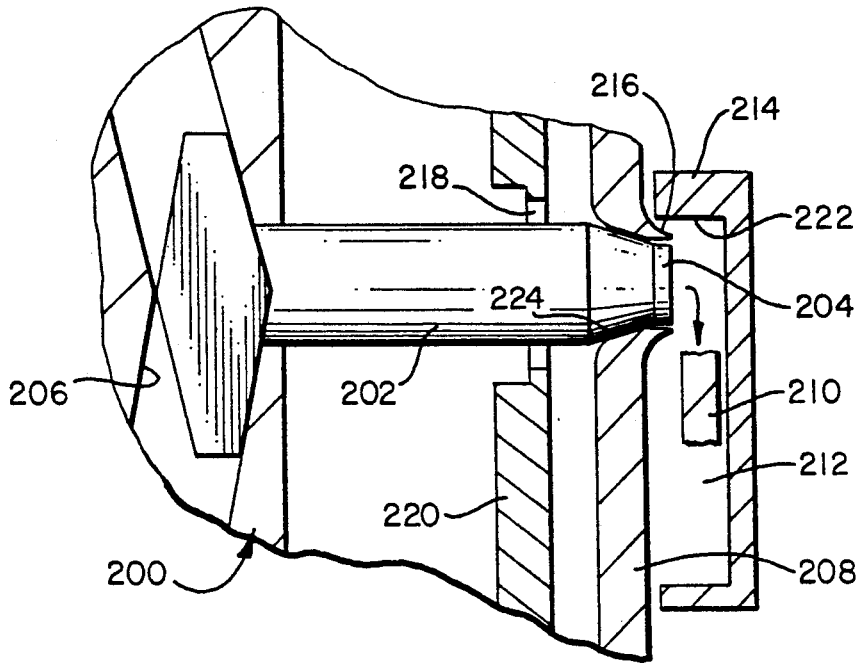
FIG. 6 is an enlarged detail view of an alternative embodiment of the invention depicting a punch adapted to perforate the piston of the valve and form an outwardly extending lip on the piston to lock the valve open.

Referring to FIG. 6, another embodiment of the invention is disclosed wherein lockout tool 200 comprises punch member 202 having a blunt circular end portion 204. As punch member 202 slides along ramp 206, blunt circular end portion 204 is forced radially outward through aperture 218 in cover plate 220 and perforates piston 208. Disk 210, which is punched out of piston 208, falls into annulus 212 within packing retainer 214. As punch member 202 perforates piston 208, a protrusion in the form of annular lip 216 is formed on the outwardly extending wall of piston 208. The formation of annular lip 216 is assisted by tapered annular shoulder 224 around punch member 202. Annular lip 216 thereafter performs the same function as tab 154 discussed above, abutting against shoulder 222 of packing retainer 214 to prevent piston 208 from shifting upwardly a sufficient distance to close the valve. In this manner, the safety valve is locked open and fluid communication is established between annulus 212 and the interior of the valve through piston 208. (Although not shown in the detail view of FIG. 6, annulus 212 is desirably in fluid communication with a control fluid flow path such as flow path 41 in FIG. 2A that communicates with a surface controller.)

Figure 7:
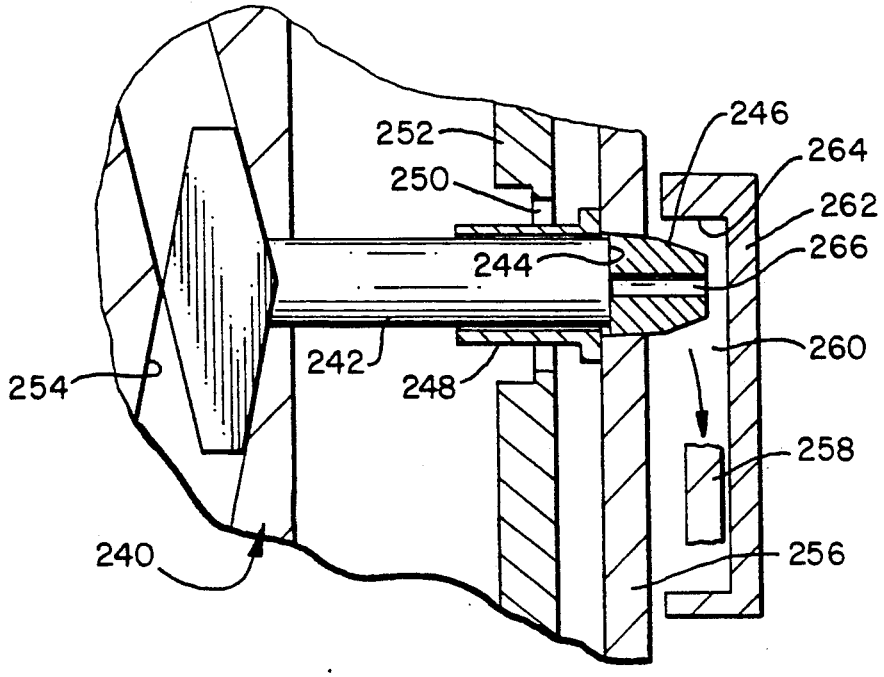
FIG. 7 is an enlarged detail view of an alternative embodiment of the invention depicting a punch adapted to perforate the piston and wedge an insert into the perforation to lock the valve open.

Referring to FIG. 7, another embodiment of the invention is disclosed wherein lockout tool 240 comprises punch member 242 desirably having a flat circular end surface 244. Tapered insert 246 is adapted to rest against surface 244 of punch member 242 prior to perforation of piston 256, and is maintained in alignment with punch member 242 by bushing 248. Bushing 248 is retained in aperture 250 and is forced out radially with punch member 242 until it is contiguous to the inside wall of piston 256. As punch member 242 slides along ramp 254, tapered insert 246 is forced radially outward through aperture 250 in cover plate 252 and perforates piston 256. Disk 258, which is punched out of piston 256, falls into annulus 260 within packing retainer 262. As tapered insert 246 perforates piston 256, it becomes tightly wedged in the hole formed in piston 256. The protruding portion of tapered insert 246 thereafter performs the same function as tab 154 discussed above, abutting against shoulder 264 of packing retainer 262 to prevent piston 256 from shifting upwardly a sufficient distance to close the valve. In this manner, the safety valve is locked open. Also, because tapered insert 246 comprises a radially extending flow channel 266, fluid communication is established between annulus 260 and the interior of the valve through piston 256. (Although not shown in the detail view of FIG. 7, annulus 260 is desirably in fluid communication with a control fluid flow path such as flow path 41 in FIG. 2A that communicates with a surface controller.)

Although the invention is described herein in relation to its preferred embodiment, it is understood that other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A downhole safety valve comprising:

a. housing means having a longitudinal bore extending therethrough;

b. valve closure means mounted in the housing means, the valve closure means being adapted to control fluid flow through the longitudinal bore;

c. the valve closure means having a first position which allows fluid flow through the longitudinal bore and a second position which blocks fluid flow therethrough;

d. a perforatable piston member slidably disposed within the housing means; and e. an operating sleeve disposed within the housing means and connected to the piston member, the operating sleeve being selectively shiftable to a position where it locks the valve closure means in the first position;

f. the perforatable piston member having a selectively formed protrusion that engages the housing means to limit subsequent motion of the operating sleeve and provides fluid communication through the piston member.

2. The safety valve of claim 1 wherein the protrusion is an outwardly extending tab.

3. The safety valve of claim 1 wherein the protrusion is an outwardly extending annular lip.

4. The safety valve of claim 1 wherein the protrusion is a frictionally engaged tapered insert having a fluid flow path therethrough.

5. A safety valve for downhole use in a well comprising:

a. housing means having a longitudinal bore extending therethrough;

b. valve closure means mounted in the housing means, the valve closure means being adapted to control fluid flow through the longitudinal bore;

c. the valve closure means having a first position which allows fluid flow through the longitudinal bore and a second position which blocks fluid flow therethrough;

d. means for releasably engaging a lockout tool introduced into the longitudinal bore for use in moving the valve closure means from the second position to the first position;

e. an operating sleeve disposed within the housing means that can be shifted by movement of the lockout tool to an open position where it maintains the valve closure means in the first position; and f. perforatable means adapted to lock the operating sleeve in the open position and provide fluid communication through the perforatable means upon perforation by the lockout tool.

6. The safety valve of claim 5 wherein the perforatable means is a piston.

7. The safety valve of claim 6, further comprising an annular recess in fluid communication with a surface controller, the annular recess having an upper shoulder, the piston being aligned with the annular recess so as to be engageable with the upper shoulder of the annular recess upon perforation by the lockout tool.

8. A lockout tool for use in permanently locking an operating sleeve of a well safety valve in a position adapted to permit fluid flow through the valve, the tool comprising:

a. means for releasably engaging the operating sleeve;
b. means for shifting the operating sleeve to a position where the well safety valve is locked open; and
c. means for perforating a piston member connected to the operating sleeve within the well safety valve to establish a fluid flow path through the piston member and simultaneously form a protrusion adapted to restrict movement of the piston member within the well safety valve and thereby maintain the operating sleeve in the position where the well safety valve is locked open after disengagement of the lockout tool from the operating sleeve.

9. The lockout tool of claim 8 wherein the means for perforating the piston member comprises a punch member adapted to be selectively shifted radially outward to perforate the piston member.

10. The lockout tool of claim 9 wherein the punch member is adapted to perforate the piston member and form a protrusion comprising a tab extending radially outward from the piston member into an adjacent recess in the well safety valve.

11. The lockout tool of claim 9 wherein the punch member is adapted to perforate the piston member and form a protrusion comprising an outwardly extending annular lip around the perforation.

12. The lockout tool of claim 9 wherein the punch member is adapted to perforate the piston member and wedge a tapered insert having a fluid flow path therethrough into the perforation.

13. A lockout tool comprising:

a. a housing with a longitudinal bore;
b. a plurality of circumferentially spaced locator keys biased to expand radially outward from the housing;
c. mandrel means slidably disposed inside the housing;
d. a punch member; and
e. a plurality of selectively releasable retaining means for restricting relative movement between the housing and the mandrel means;

the mandrel means further comprising means for selectively forcing a portion of the punch member radially outward through the housing and means for subsequently retracting the punch member back inside the housing;

the punch means further comprising means for perforating and forming an outwardly extending protrusion in a surrounding member whenever the punch member is forced radially outward through the housing, and means for establishing fluid communication through the surrounding member.

14. The lockout tool of claim 13 wherein the mandrel means comprises a track mandrel having a ramp slidably engaging the punch member, the ramp having longitudinally disposed inclining and declining sections that are respectively adapted to force the punch member radially outward and then retract the punch member radially inward upon the application of a downward force to the mandrel means that is sufficient to overpressure at least one of the retaining means and thereby permit relative motion between the housing and mandrel means.

15. The lockout tool of claim 13 wherein the mandrel means comprises at least one means for selectively maintaining the locator keys in a radially expanded position relative to the housing.

16. The lockout tool of claim 15 wherein the mandrel means comprises at least one selectively shearable means adapted to permit relative movement of the mandrel means relative to the housing to a position where the mandrel means no longer maintains the locator keys in the radially expanded position.

17. In a lockout tool adapted to be inserted into a longitudinal bore in a piston operated, surface controlled, subsurface safety valve for use in permanently locking a valve closure member disposed in the subsurface safety valve in an open position relative to the longitudinal bore, the improvement comprising perforating means adapted to penetrate through the piston and create a protrusion on the piston adapted to prevent unlocking of the valve closure member and establish fluid communication through the piston.

18. In a lockout tool adapted to be inserted into a longitudinal bore in a piston operated, surface controlled, subsurface safety valve for use in permanently locking a valve closure member disposed in the subsurface safety valve in an open position relative to the longitudinal bore, the safety valve having a housing comprising an annular recess in fluid communication with a surface controller, the improvement comprising, perforating means in the lockout tool for penetrating the piston, for creating an outwardly extending protrusion on the piston for preventing unlocking of the valve closure member, and for thereby establishing fluid communication between the annular recess and the longitudinal bore.

19. A flow control system for an oil or gas well comprising:

a. a tubing supported subsurface safety valve comprising a housing with a longitudinal bore, a valve closure member adapted to be moved from a first position blocking fluid flow through the tubing to a second position permitting fluid flow through the tubing, an operating sleeve adapted to slide downwardly within the longitudinal bore to maintain the valve closure member in the second position, and a spring-biased piston member adapted to slide in unison with the operating sleeve; and
b. a lockout tool adapted for insertion in the longitudinal bore of the safety valve, the lockout tool comprising a housing with a longitudinal bore, means disposed in the housing for releasably engaging the operating sleeve of the safety valve, and mandrel means slidably disposed in the longitudinal bore of the lockout tool;
c. the mandrel means further comprising a punch member and means for forcing the punch member radially outward to perforate the piston member when (1) the lockout tool housing and the operating sleeve are engaged, (2) the operating sleeve is maintaining the valve closure member in the second position and (3) the mandrel means is forced downward in relation to the lockout tool housing and the safety valve; and to thereby establish a fluid flow path through the piston member and form an outwardly extending protrusion on the piston member that is adapted to engage the housing of the safety valve and limit subsequent upward movement of the piston member and operating sleeve relative to the safety valve housing.

20. A method for permanently locking open a surface controlled, tubing retrievable safety valve having a longitudinal bore and for simultaneously establishing fluid communication between the valve bore and a surface controller, the method comprising the steps of:

a. introducing a tubing string including a tubing retrievable safety valve into a well bore;

b. introducing a lockout tool through the tubing string into the longitudinal bore of the safety valve, the lockout tool comprising locator means adapted to releasably engage the safety valve;

c. releasing a first retaining means within the lockout tool, thereby causing the locator means in the lockout tool to engage a profile in the safety valve;

d. shifting an operating sleeve in the safety valve to a position where it prevents closure of a valve closure means within the safety valve;

e. releasing a second retaining means within the lockout tool, thereby causing punch means within the lockout tool to perforate a piston in the safety valve at a point adjacent an annulus in the safety valve that is in fluid communication with the surface controller, to create a protrusion on the piston that locks the operating sleeve and valve closure member in the open position, and to establish fluid communication between the surface controller and the well bore; and f. causing the locator means of the lockout tool to disengage from the profile in the safety valve, permitting withdrawal of the lockout tool from the tubing string.

* * * * *